US005237845A

United States Patent [19]

Kikuchi

[11] Patent Number: 5,237,845

[45] Date of Patent: Aug. 24, 1993

[54] METHOD OF MANUFACTURING A SHUTTER FOR A PROTECTIVE ENVELOPE

[75] Inventor: Shuichi Kikuchi, Miyagi, Japan

[73] Assignee: Sony Corporation, Japan

[21] Appl. No.: 931,387

[22] Filed: Aug. 18, 1992

[30] Foreign Application Priority Data

Aug. 23, 1991 [JP] Japan ..... 3-235711

[51] Int. Cl.[5] ..... B21D 5/14; B21D 28/02

[52] U.S. Cl. ..... 72/129; 72/177; 72/181; 72/336; 360/133

[58] Field of Search ..... 72/177, 176, 179, 181, 72/161, 131, 129, 335, 336; 360/133; 206/444

[56] References Cited

U.S. PATENT DOCUMENTS

| | | | |
|---|---|---|---|
| 2,305,793 | 12/1942 | Puppe | 72/181 |
| 3,060,881 | 10/1962 | Gahlinger | 72/176 |
| 3,117,036 | 1/1964 | Cleland | 72/181 |
| 4,145,905 | 3/1979 | Mattie | 72/177 |
| 4,589,105 | 5/1986 | Nemoto | 206/444 |
| 4,698,714 | 10/1987 | Sugawara | 360/133 |
| 5,021,913 | 6/1991 | Overland | 360/133 |
| 5,036,421 | 7/1991 | Kaneda | 360/133 |

FOREIGN PATENT DOCUMENTS

| | | | |
|---|---|---|---|
| 624578 | 7/1981 | Canada | 72/176 |

*Primary Examiner*—Daniel C. Crane
*Attorney, Agent, or Firm*—Ronald P. Kananen

[57] ABSTRACT

The present invention provides a method of manufacturing a shutter to be slidably put on a protective envelope for containing a flexible disk. The method comprises cambering a flat metal strip, punching-out a blank having a shape corresponding to the development of the shutter from the cambered metal strip, and folding the blank along folding lines perpendicular to the cambered edges of the blank in a substantially U-shape. The shutter thus manufactured has opposite side walls cambered away from each other, and an end wall connecting the opposite side walls. The cambered opposite side walls of the shutter will neither diverge nor converge and the distance between the edges of the opposite side walls in sliding contact with the outer surfaces of the side walls of the protective envelope is maintained constant, so that the edges of the opposite side walls of the shutter in sliding contact with the outer surfaces of the side walls of the protective envelope do not rise from the outer surfaces of the side walls of the protective envelope.

6 Claims, 6 Drawing Sheets

10
A
B
a
b
c
d
e
7
11
13a
13b
14a
14b
15a
15b
16a
16b
17
18
19
20
21
R1
R2
W2
W4

METHOD OF MANUFACTURING A SHUTTER FOR A PROTECTIVE ENVELOPE

BACKGROUND OF THE INVENTION

1. Field of the Invention

The present invention relates to a method of manufacturing a shutter to be slidably put on a protective envelope, formed by folding a metal sheet, such as a stainless steel sheet, in a shape having a U-shaped cross section.

Description of the Prior Art

Referring to FIG. 4, a conventional protective envelope (3.5 in. MFD) 1 is formed by molding a synthetic resin, such as ABS resin, and contains a 3.5 in. flexible disk 2, i.e., a recording medium having the shape of a disk. The protective envelope 1 has opposite side walls la provided with a pair of slots 3, respectively, and a shutter 4 formed by folding a metal sheet, such as a stainless sheet, in a shape having a U-shaped cross section, is put on the protective envelope 1 so as to slide in the directions of the arrows a along the outer surfaces of the side walls 1*a* of the protective envelope 1 to close or open the slots 3 formed in the side walls 1*a* of the protective envelope 1.

Referring to FIG. 5, in manufacturing the conventional shutter 4, a flat metal strip 7 is unwound from a strip coil 6 of metal strip, such as a stainless strip, a blank 8 having the shape of the development of the U-shaped shutter 4 is punched out from the flat metal strip 7, and then the blank 8 is folded in the U-shape to complete the shutter 4. The shutter 4 has opposite side walls 41 and an end wall 42 connecting the opposite side walls 41.

When the shutter 4 is thus manufactured by the conventional method comprising steps of punching out the blank 8 from the flat metal strip 7 and folding the blank 8 in the U-shape, the opposite side walls 41 of the shutter 4 are liable to diverge and the width W1 of the shutter 4, i.e., the distance between the edges 41*a* of the opposite side walls 41, becomes excessively large as shown in FIG. 6(A) or the opposite side walls 41 of the shutter 4 are liable to converge and the width W1 becomes excessively small as shown in FIG. 6(B). If the width W1 of the shutter 4 is excessively large, the edges 41*a* of the opposite side walls 41 of the shutter 4 rise from the outer surfaces of the side walls 1*a* of the protective envelope 1 and collide against adjacent parts of a recording/reproducing apparatus in loading the protective envelope into or unloading the same from the recording/reproducing apparatus. If the width W1 of the shutter 4 is excessively small, the edges 41*a* of the opposite side walls 41 of the shutter 4 press hard on the side walls 1*a* of the protective envelope 1 to abrade the side walls 1*a* of the protective envelope 1 when the shutter 4 slides along the side walls 1*a* of the protective envelope 1. When the side walls 1*a* of the protective envelope 1 are abraded, powder of the synthetic resin forming the protective envelope 1 is produced and the powder enters the interior of the protective envelope 1 to soil the flexible disk 2, which causes drop-out in recording information on and in reproducing recorded information from the flexible disk 2.

SUMMARY OF THE INVENTION

The present invention has been made to solve the foregoing problems and it is therefore an object of the present invention to provide a method of manufacturing a shutter for a protective envelope containing a flexible disk, capable of forming a shutter having opposite side walls and an end wall connecting the opposite side walls in a correct shape so that the opposite side walls will not diverge or converge.

In one aspect of the present invention, a method of manufacturing a shutter for a protective envelope, having opposite side walls cambered away from each other and an end wall connecting the opposite side walls comprises the steps of: cambering a metal strip; punching out a blank from the cambered metal strip; and folding the blank along folding lines perpendicular to the cambered edges of the blank in a U-shape.

Since the blank is punched out from the cambered metal strip and the blank is folded along folding lines perpendicular to the cambered edges of the blank in a U-shape, the opposite side walls of the shutter will neither diverge nor converge and the shutter maintains the correct shape stably.

The metal strip is cambered by cambered rollers and hourglass-shaped rollers pressed against the cambered rollers, respectively. The working circumferences of either the cambered rollers or the hourglass-shaped rollers are formed of an elastic material to press the metal strip elastically between the cambered rollers and the hourglass-shaped rollers to camber the metal strip. Accordingly, the major surfaces of the metal strip are scarcely flawed.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

Figure 1:
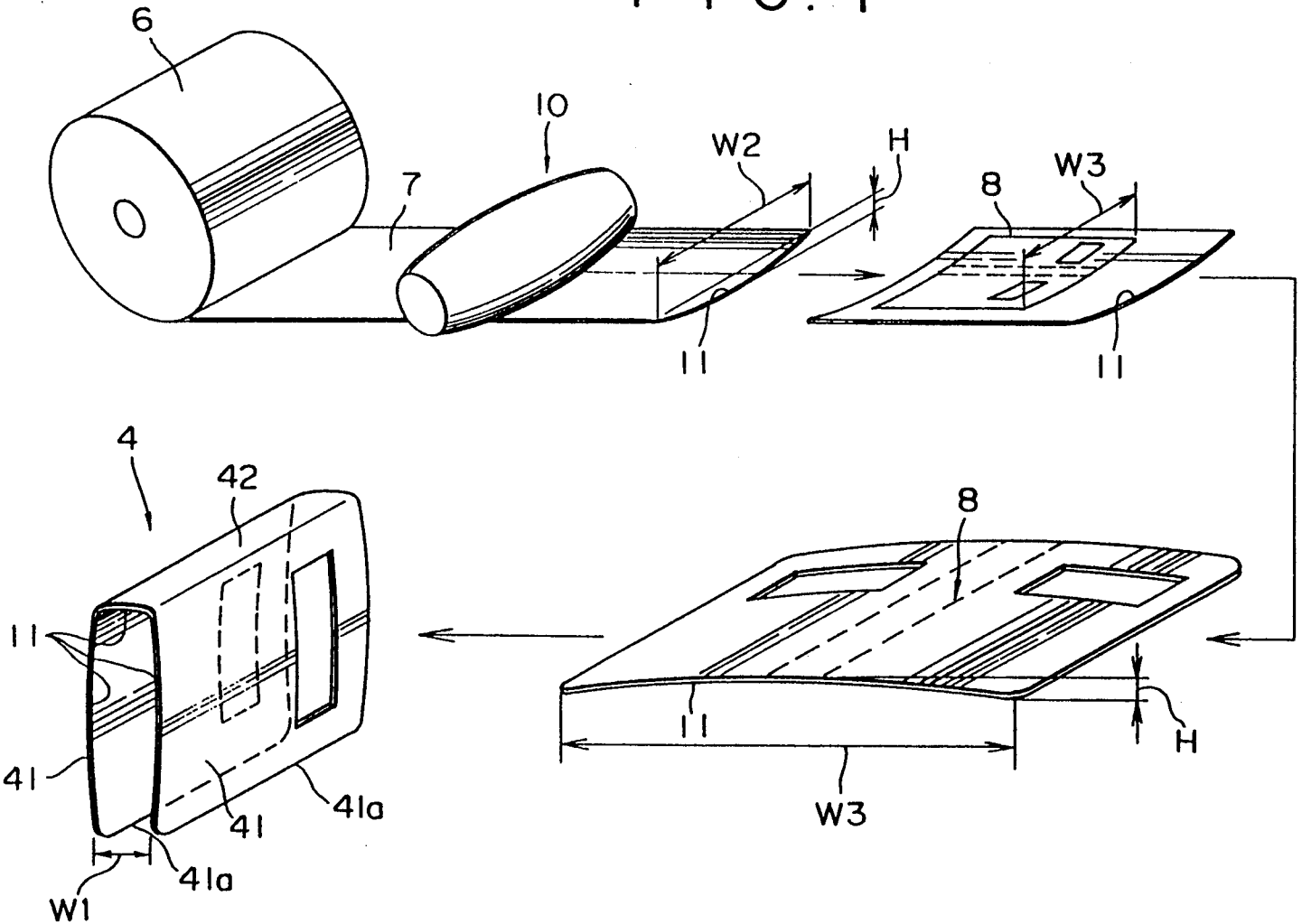
FIG. 1 is a perspective view of assistance in explaining a method of manufacturing a shutter for a protective envelope, in a preferred embodiment according to the present invention.

A method of manufacturing a shutter for a protective envelope, in a preferred embodiment according to the present invention will be described with reference to FIGS. 1, 2 and 3(A) to 3(*c*), in which parts like or corresponding to those described previously with reference to FIGS. 4, 5, 6(A) and 6(B) are denoted by the same reference characters and the description thereof will be omitted to avoid duplication.

Referring to FIG. 1, a flat metal strip 7 is unwound from a metal strip coil, such as a stainless steel strip coil. The flat metal strip 7 is a rolled strip of a stainless steel, for example, SUS 304: austenitic stainless steel having a composition: 0.5% Co, 9% Ni, 18% Cu, and iron, the remainder, having a thickness in the range of about 0.1 mm to about 0.3 mm and a width W2 in the range of about 65 mm to about 70 mm slightly greater than the width W3 of blanks 8 to be punched out therefrom.

The flat metal strip 7 is cambered widthwise to form a cambered edge 11 in the shape of a circular arc having a camber H in the range of about 0.3 mm to about 0.5 mm by a cambering apparatus 10. Since the width W2 of the flat metal strip 7 is relatively small, the flat metal strip 7 can be easily cambered and the camber H can be stably maintained. A blank 8 is punched out from the cambered metal strip 7, and then the blank 8 is folded in a U-shape along folding lines perpendicular to the cambered edges of the blank 8 to form a shutter 4 having opposite side walls 41 cambered away from each other, and an end wall 42 connecting the opposite side walls 41. Since the flat metal strip 7 having the relatively small width W2 is cambered, the blank 8 is punched out from the cambered metal strip 7, and then the blank 8 is folded in a U-shape to form the shutter 4, the opposite side walls 41 of the shutter 4 will neither diverge nor converge relative to a correct shape and maintain the correct shapes stably. Accordingly, the width W1 of the shutter, i.e., the distance between the edges 41*a* of the opposite side walls 41, becomes neither excessively large nor excessively small and hence the shutter 4 maintains its correct shape stably.

Figure 2:
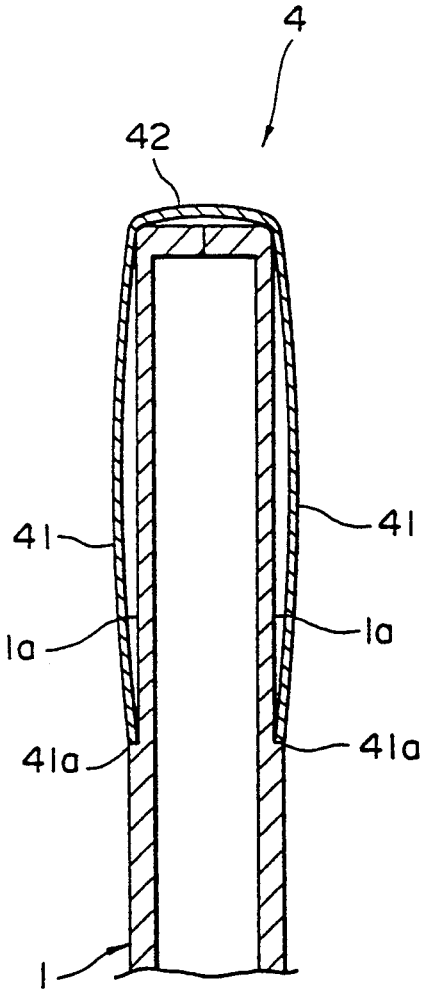
FIG. 2 is a sectional view of a protective envelope provided with a shutter manufactured by the method explained with reference to FIG. 1.

Accordingly, when the shutter 4 is put on a protective envelope 1 as shown in FIG. 2, the opposite side walls 41 of the shutter 4 tend to press on the outer surfaces of the opposite side walls la of the protective envelope 1 and the edges 41*a* of the opposite side walls 41 of the shutter 4 will not rise from the outer surface of the opposite side walls 1*a* of the protective envelope 1. Since the shutter 4 maintains its correct shape stably, the edges 41*a* of the opposite side walls 41 of the shutter will not press hard on the opposite side walls la of the protective envelope 1 and hence the shutter 4 will not abrade the opposite side walls 1*a* to produce powder.

Figures 3A, 3B, 3C:
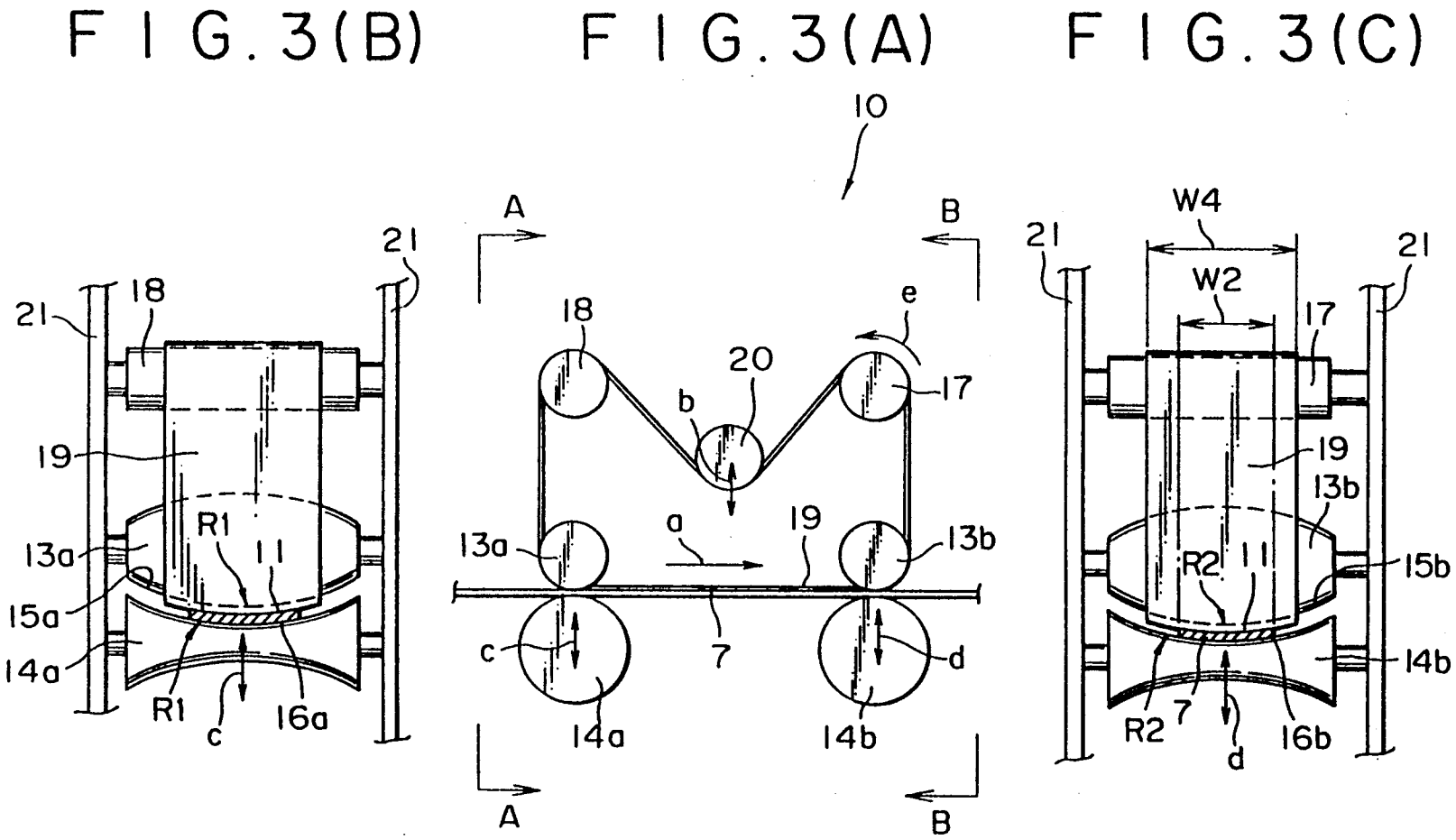
FIG. 3(A) is a side view of a cambering apparatus.
FIG. 3(B) is a view taken in the direction of the arrows along the line A—A in FIG. 3(A)
FIG. 3(C) is a view taken in the direction of the arrows along the line B—B in FIG. 3(A)
Figure 4:
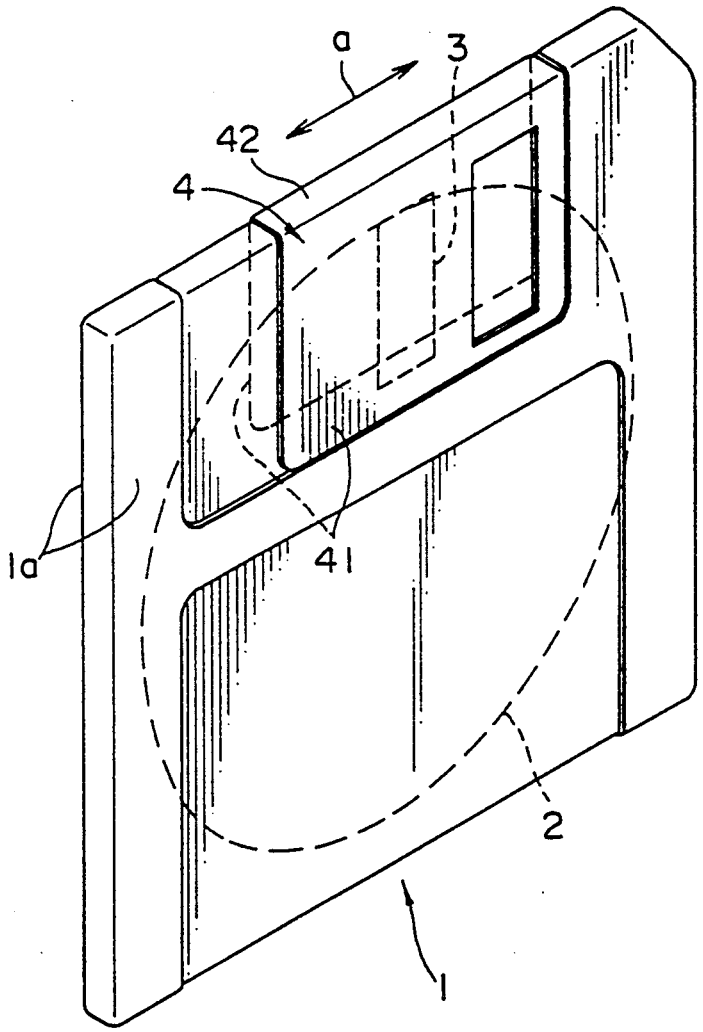
FIG. 4 is a perspective view of a protective envelope provided with a shutter.
Figure 5:
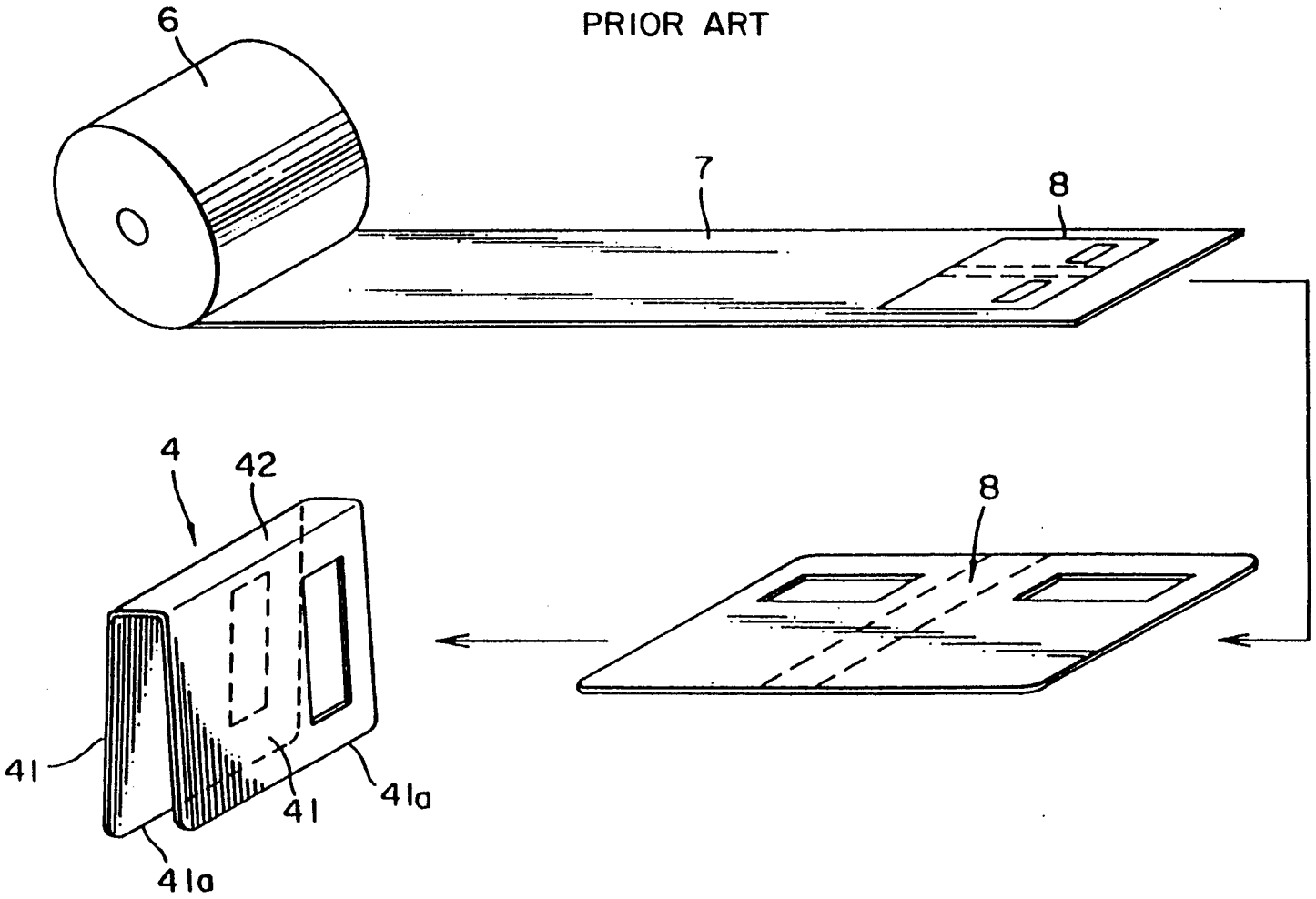
FIG. 5 PRIOR ART
FIG. 5 is a perspective view of assistance in explaining a conventional method of manufacturing a shutter.
Figure 6A:
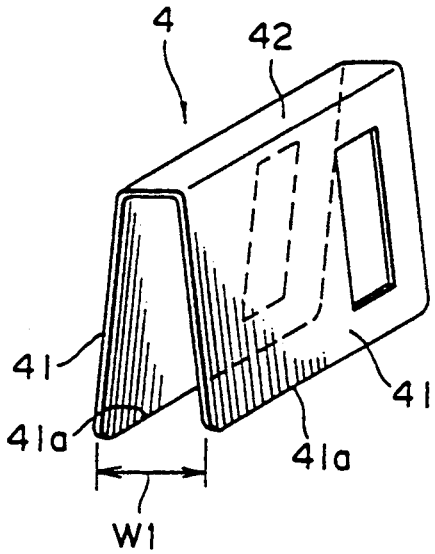
FIG. 6(A) PRIOR ART
FIGS. 6(A) and 6(B) are perspective views of shutters manufactured by the conventional method explained with reference to FIG. 5.
Figure 6B:
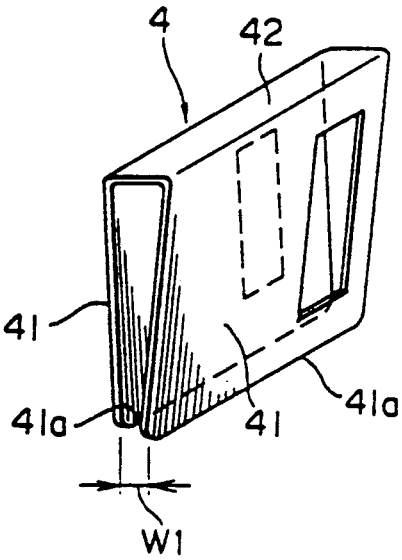
FIG. 6(B) PRIOR ART

The cambering apparatus 10 will be described hereinafter with reference to FIGS. 3(A) to 3(C).

A set of a cambered first upper roller 13*a* and an hourglass-shaped first lower roller 14*a* and a set of cambered second upper roller 13*b* and an hourglass-shaped second lower roller 14*b* are disposed at an interval on the path of the flat metal strip 7. The first upper rollers 13*a*, the second upper roller 13*b*, the first lower rollers 14*a* and the second lower roller 14*b* are formed of a metal, such as steel. The circumference 15*a* of the first upper roller 13*a* and the circumference 16*a* of the first lower roller 14*a* are complementary, and the circumference 15*b* of the second upper roller 13*b* and the circumference 16*b* of the second lower roller 14*b* are complementary. An endless belt 19 of an elastic material, such as urethane rubber, is wound around the first upper roller 13*a*, the second upper 13*b*, a driving roller 17 and a guide roller 18. A tension roller 20 is pressed against the endless belt 19 at a position between the driving roller 17 and the guide roller 18. The rollers 13*a*, 13*b*, 14*a*, 14*b*, 17, 18 and 20 are journaled on a pair of side frames 21 in a horizontal position.

The radius R1 of curvature of the respective curved surfaces 15*a* and 16*a* of the first upper roller 13*a* and the first lower roller 14*a* disposed before the second upper roller 13*b* and the second lower roller 14*b* with respect to the direction of the arrow a is greater than the radius R2 of curvature of the respective curved surfaces 15*b* and 16*b* of the second upper roller 13*b* and the second lower roller 14*b*. The radius R1 of curvature is in the range of about 70 mm to about 90 mm and the radius R2 of curvature is in the range of about 65 mm to about 85 mm. The radii R1 and R2 of curvature are determined taking into consideration the quality of the flat metal strip 7. In this embodiment, the radius R1 of curvature is 85 mm, the radius R2 of curvature is 75 mm for the flat metal strip 7 having a hardness HQ of 200 and a width of 70 mm. The width W4 of the endless belt 19 is on the order of 75 mm. The position of the tension roller 20 with respect to the directions of the arrow b is adjusted to adjust the tension of the endless belt 19. The clearance between the endless belt 19 and the first lower roller 14*a* and the clearance between the endless belt 19 and the second lower roller 14*b* can be adjusted according to variation in the thickness of the flat metal strip 7 by adjusting the respective positions of the lower rollers 14*a* and 14*b* with respect to the directions of the arrows c and d. Since the upper rollers 13*a* and 13*b* do not come into direct contact with the flat metal strip 7, the upper rollers 13*a* and 13*b* may be formed of a jig steel, such as S45C (JIS). Since the lower rollers 14*a* and 14*b* come into direct contact with the flat metal strip 7, it is preferable to form the lower rollers 14*a* and 14*b* of a tool steel, such as SKD (JIS).

The driving roller 17 is rotated in the direction of the arrow e to turn the endless belt 19 in the direction of the arrow a. The flat metal strip 7 is pressed elastically between the endless belt 19 and the first lower roller 14*a* for the first cambering stage while the flat metal strip 7 is advanced in the direction of the arrow a. Subsequently, the slightly cambered metal strip 7 is pressed elastically between the endless belt 19 and the second lower roller 14*b* for the second cambering stage while the slightly cambered metal strip 7 is advanced in the direction of the arrow a to obtain the cambered metal strip 7 having a camber H in the range of about 0.3 mm to about 0.5 mm.

Since the metal strip 7 is pressed for cambering between the endless belt 19 and the lower rollers 14*a* and 14*b*, the metal strip is not flawed. Since the elastic endless belt 19 is cambered in shapes respectively conforming to the respective cambered circumferences 15*a* and 15*b* of the upper rollers 13*a* and 13*b*, and the lower rollers 14*a* and 14*b* are rotated in perfect synchronism with the turning of the endless belt 19, there is no slip at all between the endless belt 19 and the lower rollers 14*a* and 14*b* and hence the surface of the metal strip 7 is not subject to abrasive flawing. Since the width W2 of the flat metal strip 7 is relatively small, the flat metal strip 7 can be properly and surely cambered.

Either the upper rollers 13*a* and 13*b* or the lower rollers 14*a* and 14*b* may be formed of an elastic material, such as urethane rubber, and the endless belt 19 may be omitted.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A method of manufacturing a shutter having a cross-sectional U-shape comprising opposite side walls cambered away from each other and an end wall connecting the opposite side walls, to be slidably put on a protective envelope containing a flexible disk, said method comprising steps of:

providing a substantially flat metal strip and cambering the metal strip;

punching out a blank of a shape corresponding to the development of the shutter from the cambered metal strip so that cambered edges are formed along opposite edges of the metal strip; and folding the blank along folding lines extending perpendicular to the cambered edges of the blank into the shape of said shutter having a substantially U-shape comprising opposite side walls cambered away from each other and an end wall connecting the opposite side walls.

2. A method according to claim 1, wherein the metal strip is cambered at a plurality of cambering stages.

3. A method according to claim 2, wherein the metal strip is pressed for cambering between a cambered upper roller and a hourglass-shaped lower roller engaging the cambered upper roller at each of the plurality of cambering stages, and the respective circumferences of the cambered upper roller and the hourglass-shaped lower roller are substantially complementary.

4. A method according to claim 3, wherein an elastic, endless belt having a working surface layer formed of an elastic, rubber-like material is wound around the cambered upper rollers of the plurality of cambering stages so that the working surface will be in contact with the metal strip.

5. A method according to claim 3, wherein the respective surface layers of the cambered upper rollers are formed of an elastic, rubber-like material.

6. A method according to claim 3, wherein the respective surface layers of the hourglass-shaped lower rollers are formed of an elastic, rubber-like material.

* * * * *